US006126083A

United States Patent [19]

Boschung et al.

[11] Patent Number: 6,126,083

[45] Date of Patent: Oct. 3, 2000

[54] METHOD AND A STATIONARY ARRANGEMENT FOR DISCHARGING A DEICING LIQUID

[75] Inventors: Marcel Boschung, Neyruz; Theodor Weber, Wabern, both of Switzerland

[73] Assignee: Boschung Company Inc., Brainerd, Minn.

[21] Appl. No.: 09/172,012

[22] Filed: Oct. 14, 1998

[30] Foreign Application Priority Data

Mar. 20, 1998 [EP] European Pat. Off. ..... 98 105 077

[51] Int. Cl.[7] ..... B05B 17/00

[52] U.S. Cl. ..... 239/1; 239/201; 239/207

[58] Field of Search ..... 239/1, 66, 70, 239/170, 172, 200, 201, 202, 207; 404/71, 111; 244/134 R, 134 C; 37/227

[56] References Cited

U.S. PATENT DOCUMENTS

| | | | |
|---|---|---|---|
| 3,403,818 | 10/1968 | Enssle . | |
| 4,557,420 | 12/1985 | Boschung et al. . | |
| 5,447,272 | 9/1995 | Ask . | |
| 5,540,383 | 7/1996 | Ducey | 239/1 |

FOREIGN PATENT DOCUMENTS

| | | | |
|---|---|---|---|
| 0458992 | 12/1991 | European Pat. Off. . | |
| 0461295 | 12/1991 | European Pat. Off. . | |
| 18209 | 2/1914 | France . | |
| 2574833 | 6/1986 | France . | |
| 3236401 | 4/1984 | Germany . | |
| 3515896 | 11/1986 | Germany . | |
| 13612 | 1/1991 | Japan | 239/202 |
| 8-269927 | 10/1996 | Japan . | |
| 658411 | 11/1986 | Switzerland . | |
| 288364 | 4/1928 | United Kingdom . | |
| 97/24969 | 7/1997 | WIPO . | |

OTHER PUBLICATIONS

Moritz et al., "Planung und Betrieb von Taumittel–Sprühanlagen," *Strassen und Tiefbau*, vol. 48, No. 12, pp. 11–13 (Jan. 1994).

*Primary Examiner*—Andres Kashnikow
*Assistant Examiner*—Lisa Ann Douglas
*Attorney, Agent, or Firm*—Greenblum & Berstein, P.L.C.

[57] ABSTRACT

Method and arrangement for dispensing a deicing liquid onto a traffic area through a stationary spraying arrangement. The method includes generating deicing liquid jets in the spraying arrangement, and discharging an amount of deicing liquid from each deicing liquid jet at a rate of less than approximately 1 l/min. The arrangement includes at least one deicing liquid pump, at least one deicing liquid conduit coupled to the at least one deicing liquid pump, and a plurality of spraying heads coupled to the at least one deicing liquid conduit. The spraying heads include at least one outlet opening having an inner diameter between approximately 0.1 mm and 1 mm.

29 Claims, 4 Drawing Sheets

METHOD AND A STATIONARY ARRANGEMENT FOR DISCHARGING A DEICING LIQUID

CROSS REFERENCE TO RELATED APPLICATIONS

The present application claims priority under 35 U.S.C. § 119 of European Patent application No. 98105077.6 filed Mar. 20, 1998, the disclosure of which is expressly incorporated by reference herein in its entirety.

BACKGROUND OF THE INVENTION

1. Field of the Invention

The present invention relates to a method for bringing out or discharging a liquid onto a traffic area that prevents the formation of ice or thaws ice that has already built up. Such a liquid, generally referred to as deicing liquid, is discharged by stationary discharging means.

The present invention further relates to a spraying head for discharging deicing liquid and to an arrangement for discharging deicing liquid that includes a deicing liquid tank, a deicing liquid pump, and at least one conduit for deicing liquid fed by the pump.

2. Discussion of the Background Information

Stationary arrangements for discharging of a deicing liquid are known, e.g., from the European patent application No. 0 458 992. Such discharging or spraying arrangements apply deicing liquid, which is usually a solution of NaCl, to a traffic area, e.g., roads, highways, bridges, airport runways and taxi strips. The discharging of deicing liquid is performed by nozzles which are arranged, e.g., at guard rails along the side of the traffic area or in the surface of the traffic area, as is disclosed, e.g., in Swiss patent No. 658 411 and European patent application No. 0 461 295, respectively.

The known arrangements for discharging deicing liquid produce strong jets of deicing liquid of a very short duration, usually 1 to 2 seconds, so as not to disturb traffic. Strong, long-distance jets, e.g., approximately 10 meters, use between 0.2 and 1 liter per second of fluid. This manner of discharging the liquid necessitates either conduits with a considerable inner diameter or local pressure reservoirs, as disclosed in European patent application No. 0 458 992. Further, controllable valves, e.g., electrically controllable valves, are necessary for the short-time activation of the deicing liquid discharge. Thus, electrical control lines are also necessary.

Further, it is possible that the short-time, strong prior art jets may lead to a panic reaction by drivers that could potentially cause accidents, even if such a panic reaction occurs in only a few cases.

SUMMARY OF THE INVENTION

Hence, the present invention provides a method for discharging a deicing liquid that does not suffer from the above-mentioned drawbacks, and provides a simple and inexpensive method that reduces the danger of panicky reactions by drivers when the deicing process is activated.

In order to implement the features of the present invention, which will be more readily discussed hereinbelow, the method includes discharging deicing liquid in liquid jets that have a capacity of, e.g., between approximately 0.1 liters per minute and 1 liter per minute, and preferably, between approximately 0.1 liters per minute and 0.5 liters per minute.

By discharging very fine jets having, a fluid capacity considerably less than that of the prior art jets, the possibility of suddenly frightening drivers of cars or motorcycles is reduced. That is, the very fine jets are substantially invisible to the human eye and do not generate substantially audible noises when they contact the vehicle. Further, the small amount of liquid discharged by each jet, and also by several jets, produces no significant reduction in the pressure within the deicing liquid conduits. This reduced fluid capacity allows the use of small diameter conduits. Accordingly, the costs of material and the costs for laying the conduits are reduced considerably. The method of the present invention further enables starting and stopping of the spraying of the deicing liquid by activating and deactivating the deicing liquid pump during a predetermined time. In this manner, the large number of valves required by the systems of the prior art may be dispensed with.

The deicing liquid is preferably discharged for a duration, e.g., between approximately 10 seconds and 10 minutes, preferably between approximately 30 seconds and 10 minutes, and most preferably between approximately 30 seconds and 5 minutes. Thus, the discharge duration in accordance with the present invention is significantly increased over the prior art which utilizes a duration of about 1 to 2 seconds.

The above mentioned features further include a plurality of discharge points for discharging deicing liquid that are provided so that each discharge point supplies deicing liquid to, e.g., between approximately 15 $m^2$ and 40 $m^2$ of traffic area, e.g., roadways.

Such a large number of discharge posts or points, i.e., when compared to the prior art, allows the generation of very fine jets that are substantially invisible and that do not reach very far. In this manner, the above-mentioned advantages and effects are achieved, and a sufficiently distributed discharging of deicing liquid on the traffic area results.

The present invention also includes a spraying body for discharging deicing liquid that has a single or a plurality of outlet openings for the liquid having an inner diameter of, e.g., between approximately 0.1 mm and 1 mm, and preferably between approximately 0.3 mm and 0.6 mm. Outlets of such a small diameter, particularly in the form of nozzles, produce or discharge a small amount of liquid.

The present invention also includes a deicing liquid spraying arrangement having a deicing liquid tank, a deicing liquid pump, at least one conduit fed by the pump, and at least one spraying body coupled to the conduit. The outlets of the at least one spraying body have an inner diameter of, e.g., between approximately 0.1 mm and 1 mm, and preferably between approximately 0.3 mm and 0.6 mm.

The deicing liquid spraying arrangement includes a plurality of discharge posts and includes a ratio of the area (in square meters) of the traffic area (e.g., roadway area) and the number of discharge posts. This ratio is, e.g., between approximately 15–40 $m^2$ to 1 so that one discharge post is provided for each 15 to 40 square meters of traffic area.

Accordingly, the present invention is directed to a method for dispensing a deicing liquid onto a traffic area through a stationary spraying arrangement. The method includes generating deicing liquid jets in the spraying arrangement, and discharging an amount of deicing liquid from each deicing liquid jet at a rate of less than approximately 1 l/min.

In accordance with another feature of the present invention, the discharge rate of the deicing liquid is between approximately 0.1 and 1 l/min.

In accordance with still another feature of the present invention, the discharge rate of the deicing liquid is between approximately 0.1 and 0.5 l/min.

The present invention is also directed to a method for the dispensing deicing liquid on lanes of roadways that includes discharging a deicing medium from spraying point arranged one of on or near the lanes at a ratio of roadway area in square meters to number of spraying points of greater than approximately 15:1.

In accordance with a further feature of the present invention, the ratio is between approximately 15:1 and 40:1.

In accordance with another feature of the present invention, the spraying points are composed of spraying heads substantially flushly mounted with the road surface, and the discharging of deicing medium includes discharging at least one jet of deicing liquid from the spraying heads. Further, the spraying heads can be structured and arranged to discharge two jets of deicing liquid.

In accordance with still another feature of the present invention, the spraying heads include nozzles for discharging the jets of deicing liquid, the nozzles have a smallest inner diameter of between approximately 0.1 mm and 1 mm, and a pressure of the deicing liquid at an inlet of the nozzle is between approximately 5 bar and 20 bar. Further, the smallest inner diameter of the nozzles being between approximately 0.3 mm and 0.6 mm. Further still, the pressure of the deicing liquid at the inlet of the nozzle being between approximately 10 bar and 15 bar.

In accordance with a further feature of the present invention, a duration of the discharging of the jets of deicing liquid is between approximately 10 seconds and 10 minutes. Further, the duration of the discharging is between approximately 30 seconds and 5 minutes.

In accordance with another feature of the present invention, the jets of deicing liquid is ejected a distance between approximately 1.0 and 4.0 m. Further, the jets are ejected a distance between approximately 1.5 and 2.5 m.

The present invention is directed to a spraying head for discharging a deicing liquid that includes at least one opening having an inner diameter between approximately 0.1 mm and 1 mm.

In accordance with still another feature of the present invention, the inner diameter is between approximately 0.3 mm and 0.6 mm. Further, the outlet opening includes nozzles having a smallest inner diameter between approximately 0.1 mm and 1.0 mm.

The present invention is directed to an arrangement for dispensing deicing liquid that includes at least one deicing liquid pump, at least one deicing liquid conduit coupled to the at least one deicing liquid pump, and a plurality of spraying heads coupled to the at least one deicing liquid conduit. The spraying heads include at least one outlet opening having an inner diameter between approximately 0.1 mm and 1 mm.

In accordance with a further feature of the present invention, the inner diameter of the outlet opening is between approximately 0.3 mm and 0.6 mm.

In accordance with another feature of the present invention, the at least one outlet opening comprising nozzles having a smallest inner diameter between approximately 0.1 mm and 1 mm.

In accordance with still another feature of the present invention, the at least one deicing liquid conduit includes a ring conduit having tap lines coupled to said spraying heads.

In accordance with a still further feature of the present invention, valves are coupled to the at least one deicing liquid conduit. In this manner, at least sections of the at least one deicing liquid conduit is filled with liquid when the pump is in deactivated state.

The present invention is directed to a process for dispensing a deicing liquid onto a traffic area. The process includes arranging a plurality of spraying heads at least one of in and along the traffic area, the spraying heads being arranged so that a ratio of an area of the traffic area in square meters the number of spraying heads is between approximately 15:1 and 40:1, and discharging the deicing liquid through the spraying heads at a rate between approximately 0.1 and 1.0 l/min.

In accordance with still another feature of the present invention, the process including discharging the deicing liquid through the spraying heads for a duration of between approximately 10 seconds and 10 minutes.

In accordance with yet another feature of the present invention, the process includes discharging the deicing liquid through the spraying heads a distance of between approximately 1.0 and 4.0 meters.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
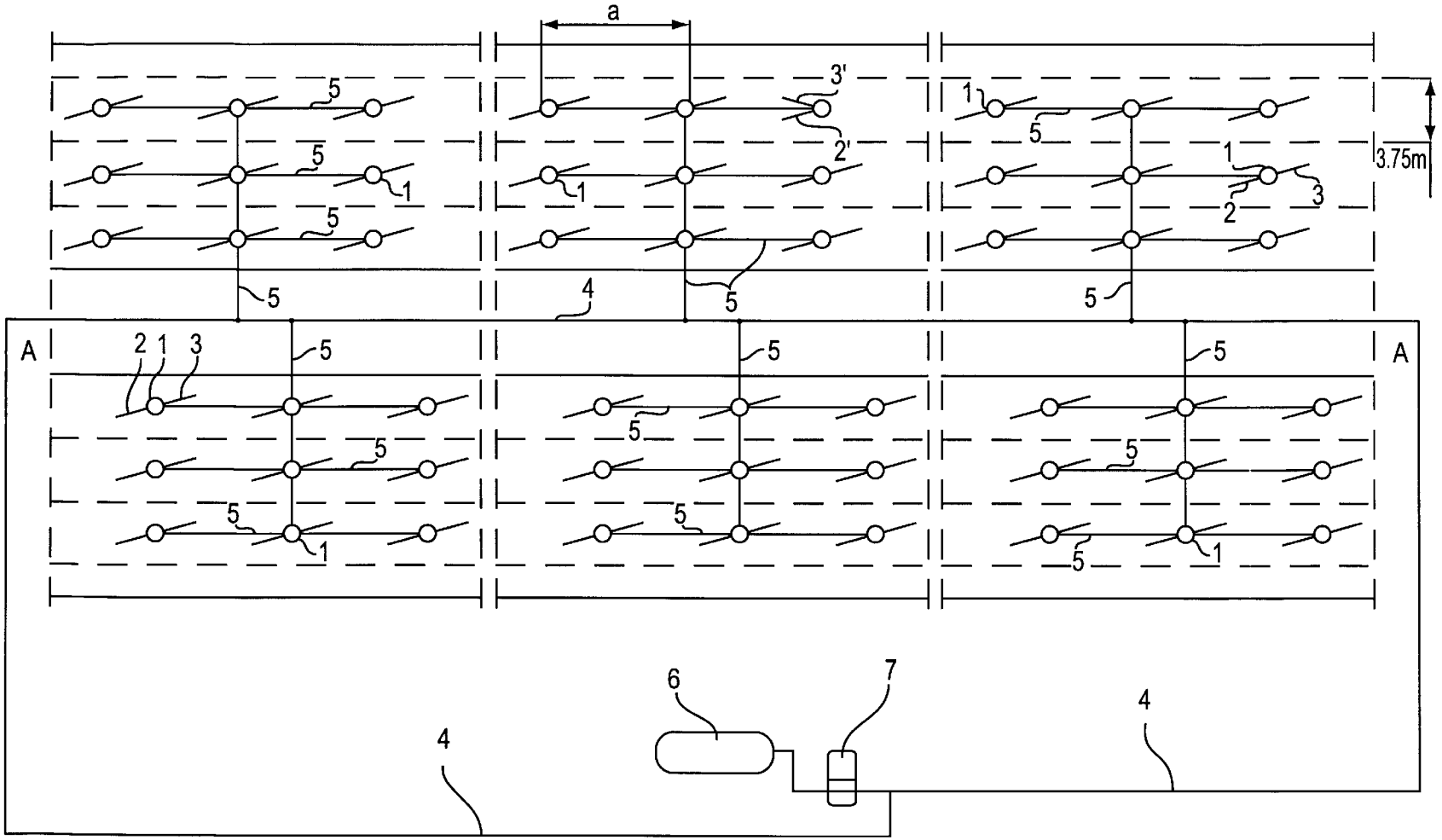
FIG. 1 illustrates a schematic view of a deicing liquid spraying arrangement on a highway.
Figure 3:
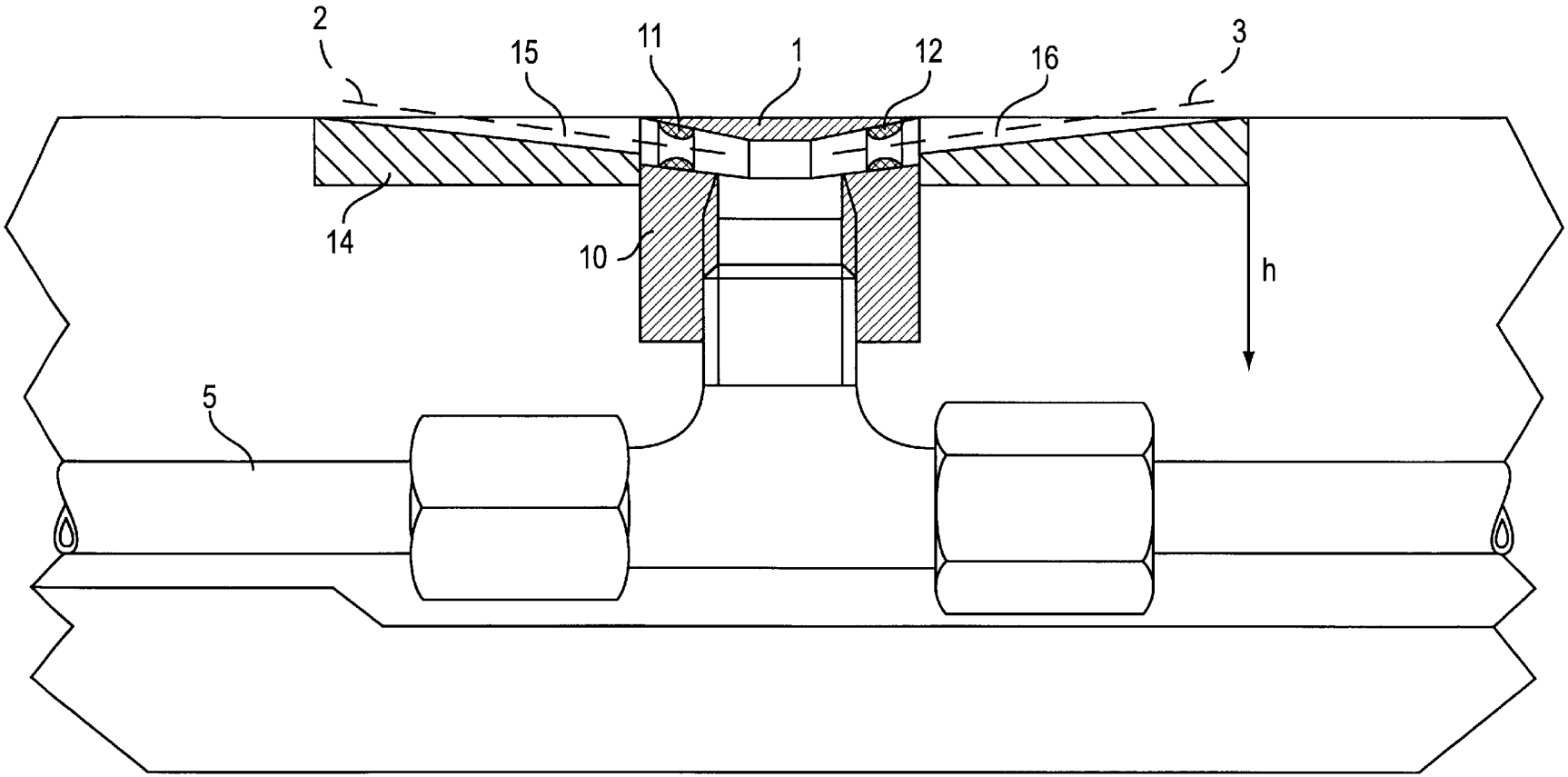
FIG. 3 schematically illustrates a vertical sectional view of a spraying body.

FIG. 1 illustrates a schematic representation of an arrangement for discharging deicing liquid viewed from above a highway having six lanes. Each lane has a width of 3.75 m. A plurality of spraying or discharge posts (points or heads) 1 are shown within the lanes. Discharge posts 1 are, e.g., spraying heads that are incorporated into or located within the road surface, as shown in FIG. 3. In this manner, discharge posts 1 may be driven over by vehicles. Each of the spraying heads 1 emits or discharges, e.g., two oppositely directed deicing liquid jets 2 and 3, or, in an alternative embodiment, two deicing jets 2' and 3' may be directed in a same direction into adjacent lanes. Jets 2 and 3 (or 2' and 3') are emitted from spraying head 1 in a non-parallel direction to the lane. Spraying heads 1 may be fed with deicing liquid by conduits 4 and 5 that are arranged such that, outside the lanes, the conduits are below or above the surface, and within the lanes, the conduits are below the surface. A deicing liquid tank 6 is provided for storing the deicing liquid that is to be fed by a deicing liquid pump 7 to spraying heads 1 via conduits 4 and 5. As noted above, the width of a single lane is approximately 3.75 meters (approximately 148 inches), and a distance "a" between spraying heads is, e.g., between approximately 6 meters and 10 meters (approximately 236 and 394 inches). If, for example, a distance of 6 meters is selected as distance "a", a traffic area of 607.5 square meters may be sprayed by 27 spraying heads 1. This would result in a ratio of traffic area per spraying head of 22.5 $m^2$. If, for example, a distance "a" of 10 meters is selected, the ratio corresponds to 37.5 $m^2$. As a rule, a value of 15 $m^2$, preferably 20 $m^2$, and up to 40 $m^2$ will show good results.

The high number of spraying heads 1 is clearly different than in the prior art, where a small number of heads emit strong and long distance jets. For example, in the above discussed example, only 14 prior art heads would have been used, instead of the 27 used by the present invention.

In the exemplary embodiment, each jet 2 and 3 extends or reaches a distance of, e.g., between approximately 1 to 4 meters, preferably between approximately 1.5 and 2.5 meters, and in the exemplary embodiment, about 2 meters. Jets 2 and 3 are very fine jets that are almost invisible and that are emitted under high pressure. The amount of liquid discharged is, e.g., between approximately 0.1 and 1 liter per minute, preferably between approximately 0.1 and 0.8 liters per minute, and most preferably between approximately 0.1 and 0.5 liters per minute. Thus, jets 2 and 3 have a substantially reduced output as compared to the prior art due to the very small output openings of each spraying head 1. The output openings have a diameter of, e.g., between approximately 0.1 mm and 1 mm, and preferably between approximately 0.3 mm and 0.6 mm. These fine jets may be generated with a pressure of the liquid in the spraying head 1 of, e.g., between approximately 5 and 20 bar, preferably between approximately 8 bar and 15 bar, and most preferably between approximately 10 bar and 15 bar. The spraying heads may be fed with deicing liquid under the above-noted pressure via conduits 4 and 5.

Conduit 4, as a main conduit, may have an inner diameter of, e.g., only 14 mm. However, this diameter is sufficient due to the small amount of deicing liquid leaving the small output openings, and, therefore, the flow of deicing liquid in the conduit produces a substantially insignificant reduction in the pressure in the conduit. Conduits 5 leading to each subgroup of spraying heads 1 may have an inner diameter of, e.g., only 4 mm. Accordingly, the laying of conduits 4 and 5 is facilitated by the small diameters, as well as less expensive. Conduit 4 can be a ring conduit, as shown in the exemplary figure, so that the same pressure is provided at both ends A—A of the feeding line. A ring line further allows a simple flushing of the conduit. However, because of the small amount of deicing liquid ejected or discharge per unit of time by all spraying heads 1, a single non-ring conduit 4 may also be sufficient for feeding.

The start and the end of discharging deicing liquid is prompted by activation and deactivation of pump 7, respectively. Due to the small amount of deicing liquid ejected by the very fine jets of deicing liquid, a discharge time is utilized that is considerably longer than the 1–2 second discharge time of the prior art systems. The discharge time in the prior art systems were also controlled by valves. In accordance with the method and deicing arrangements with the features of the present invention, a discharge duration for the very fine jets of deicing liquid may be, e.g., between approximately 10 seconds and 10 minutes or even, and preferably between approximately 30 seconds and 5 minutes. The duration, of course, is related to the kind of spraying. That is, for preventive deicing liquid spraying, i.e., where the effective amount of deicing substance is approximately 2 $g/m^2$, the discharge duration will be, e.g., approximately 30 seconds for discharging an amount of the liquid deicing solution that is, e.g., a 20% solution of NaCl. In order to combat an acute ice formation, an effective need for a deicing substance in the range of 15 to 20 $g/m^2$ is desirable, and a spraying duration of, e.g., several minutes may be used. The long discharge duration according to the present invention is further favorable for spreading the deicing liquid, since changing wind directions during the spraying process have a positive influence on the spreading. Further, air turbulences caused by vehicles may also be useful in spreading the deicing liquid during long spraying times.

In the exemplary arrangement there are no controlled valves in the conduits. Thus, all of the spraying heads 1 start ejecting deicing liquid when pump 7 is activated.

Figure 2:
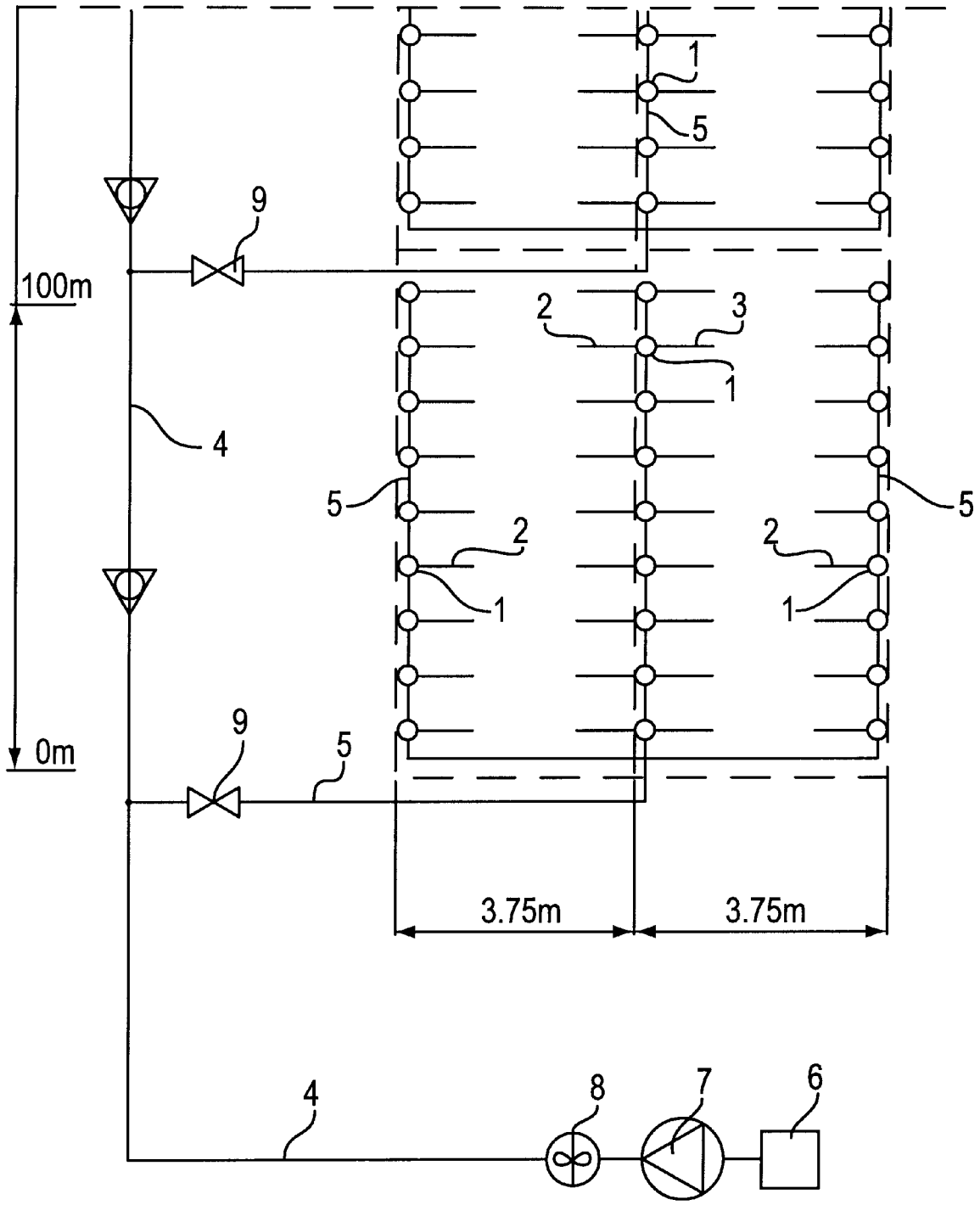
FIG. 2 illustrates another embodiment of a deicing liquid spraying arrangement.

In accordance with an alternative embodiment of the present invention, as illustrated in FIG. 2, controllable valves 9 may be coupled to conduits 5 branching from conduits 4, so that the spraying of selected single sections of the lanes can be controlled. In FIG. 2, two lanes, having a width of, e.g., 3.75 meters, are shown. A plurality of spraying heads 1 are also schematically shown. Spraying heads 1 may be positioned at an edge of each lane and adapted to generate only one spraying jet 2 directed toward the center of the lane, and spraying heads 1 may also be positioned between the lanes and adapted to generate two spraying jets 2 and 3 directed toward the lane centers. The spraying pressure is generated by pump 7 fed and from a liquid tank 6. A liquid meter 8 can be provided in the conduit. Conduit 4 leads to spraying sections served by conduits 5. Conduits 5 are coupled to main conduit 4 by controllable valves 9 so that the lanes may be divided into several spraying sections which may be separately activated and deactivated by controlling valves 9. In the two exemplary embodiments shown, it is also possible to use a plurality of parallel conduits, even with different diameters, in place of a single conduit 4.

The exemplary embodiment may also utilize non-return valves within conduit 4 to prevent a flowing back of liquid toward pump 7 when the pump is not activated. Of course it is also possible to omit these valves when a flowing back is wanted. It is usually preferred to have no liquid within conduits 5 after spraying because it enables a quick change to different kinds of deicing liquid in accordance with different freezing temperature ranges, these different liquids may not be compatible with each other. With respect to FIG. 1, it is noted that controlled valves and/or non-return valves may also be utilized with that exemplary arrangement, i.e., if it is desired to a control spraying of sections of the lanes.

FIG. 3 schematically shows a sectional view of spraying head 1 that generates two deicing liquid jets 2 and 3. Spraying head 1 includes a first part 10 that forms a connection for coupling to conduit 5 and output openings for jets 2 and 3. The output openings may be provided with nozzles 11 and 12 having a smallest inner diameter of, e.g., between approximately 0.1 mm and 1 mm, preferably between approximately 0.3 mm and 0.6 mm or 0.8 mm, for generating the desired very fine jets. Further, spraying head 1 may be provided with a supporting flange or disk 14 having recesses 15 and 16 for jets 2 and 3, respectively. Flange 14 facilitates embedding spraying head 1 into the surface of the traffic area. First part 10 and disk 14 may be formed as two pieces (as shown) or may be a single piece (not shown). First part 10 may be made of, e.g., a metal or a plastic material, and disk 14 may be made of, e.g., a plastic material such as POM (polyoxymethylenes). The exemplary embodiment of spraying head 1 combines low production costs and a low height h of, e.g., approximately 30 mm or less. In this manner, spraying head 1 may be mounted into surfaces of bridges without the danger of injuring isolation layers or mounted into porons asphelt surfaces. Spraying head 1 shown in FIG. 3 is for illustrative purposes and the discussed features should not be construed as limiting. For example, a large number of spraying points can be arranged and provided with openings or nozzles in a conduit laid near a lane, on a lane, or in the surface of a lane so that the conduit forms an elongated spraying body with a plurality of openings, e.g., in the form of nozzles.

Figure 4:
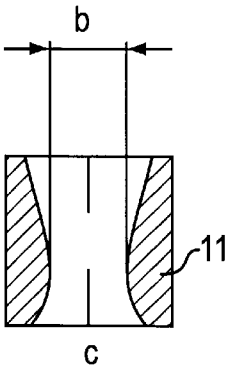
FIG. 4 illustrates a sectional view of a nozzle.

FIG. 4 schematically shows a sectional view of a nozzle 11 (or 12) in accordance with the present invention. The smallest inner diameter b may be, e.g., between approximately 0.1 and 1 mm, and preferably between approximately 0.1 and 0.6 mm or 0.3 and 0.6 mm. The nozzle is fed with deicing liquid under a pressure of, e.g., between approximately 8 and 15 bar (1160 and 2175 psi) and generates the very fine liquid jets that are substantially invisible to the human eye. Even a plurality of such nozzles would result in a very small discharge aperture. For example, 100 nozzles having a diameter of 0.6 mm result in an aperture of only 28 square millimeters, and a conduit having an inner diameter of 14 mm has a cross-sectional area of about 154 square millimeters. Thus, the conduit is able to feed a very large number of spraying points 1 along its length without a relevant loss of pressure.

A too great pressure loss may be further avoided by continuously discharging the liquid fed by the pump so that the conduits are continuously transporting a smaller amount of liquid. That is, if only one-half the amount is transported, the pressure loss is only one-quarter. This effect was not used in the prior art deicing arrangements.

Figure 5A:
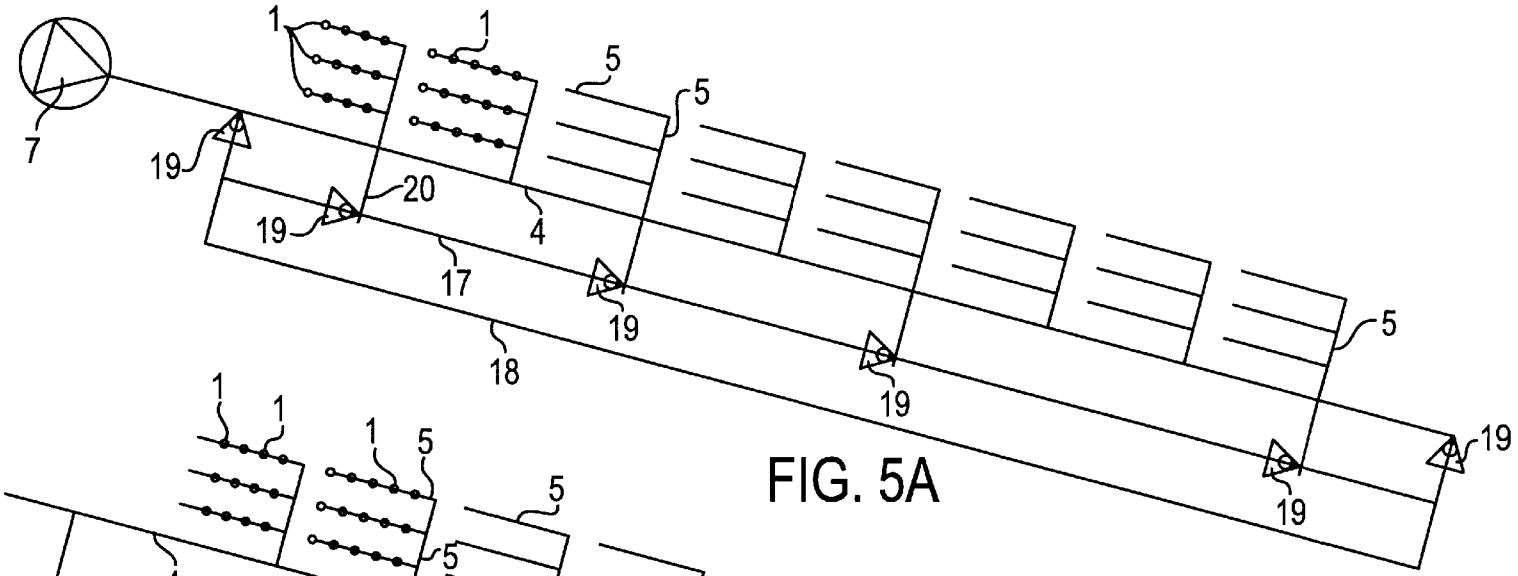
FIGS. 5*a* and 5*b* illustrate schematic diagrams of deicing liquid distributing and spraying arrangements.
Figure 5B:
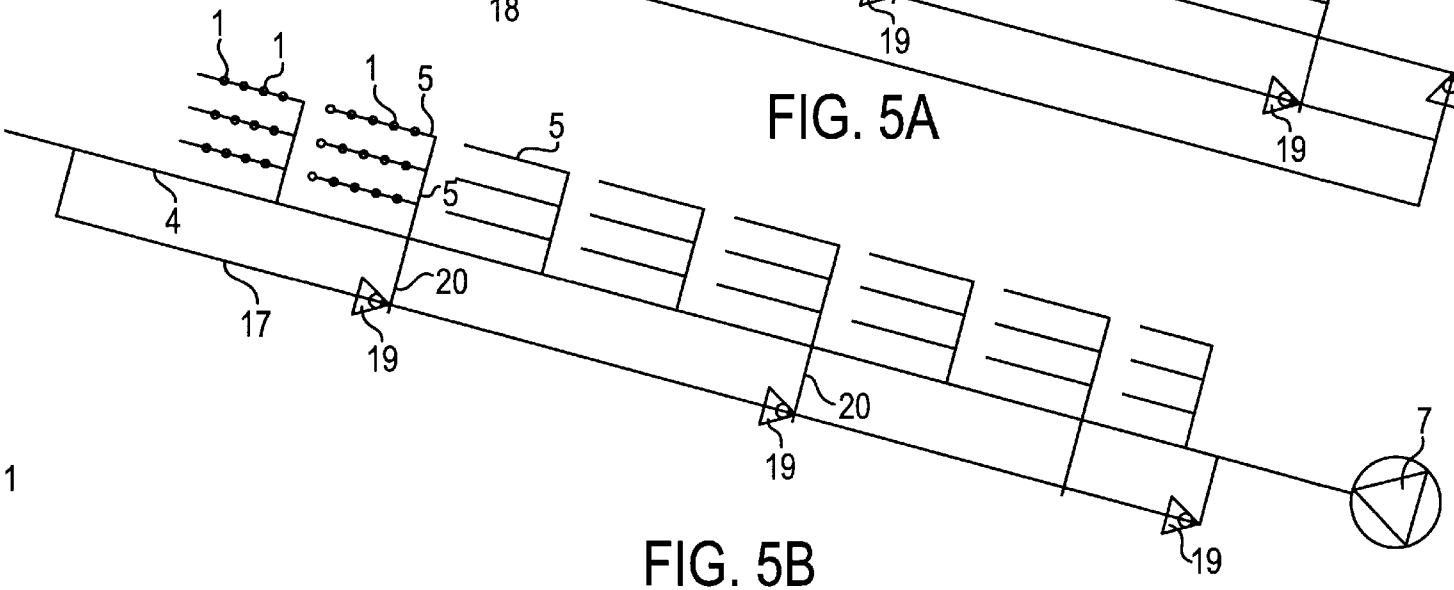

FIGS. 5*a* and 5*b* schematically illustrate very simplified deicing liquid spraying arrangements with a pump 7 coupled to a deicing liquid tank (not shown) and with a plurality of spraying points 1 fed by small diameter conduits 5, as discussed above. In addition to conduit 4, additional conduits are provided, e.g., a feeding conduit 17 (FIG. 5*b*) and additionally a by-pass conduit 18 (FIG. 5*a*). Non-return valves 19 are provided as well. As shown in FIG. 5*b*, pump 7 may be provided at a lowest point of conduits 4 and 17 that are laid along a sloping lane. As shown in FIG. 5*a*, pump 7 may be arranged at the highest point in the sloping grade. The conduits are arranged in these exemplary embodiments so that diameters as small as possible can be utilized, and so that feed conduit 17 and/or by-pass conduit 18 will remain filled with liquid when pump 7 is deactivated. In this manner, a rapid spraying along the whole length of the lane may be obtained after reactivation of pump 7. This rapid spraying is the result of connecting conduits 20 and non-return valves 19. Even conduits 5 were empty, it is possible to spray only a short time after activation of pump 7 because conduits 4, 17 and 18 remain more or less liquid-filled, i.e., depending on the specific placement of non-return valves 19 within the arrangement. Electrically controllable valves may be utilized in place of the simple non-return valves 19 to retain a liquid reserve in conduits 4, 17 and 18 when pump 7 is deactivated.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A method for dispensing a deicing liquid onto a traffic area through a stationary spraying arrangement comprising:

providing a plurality of spraying heads in the spraying arrangement, each spraying head having an opening with a smallest inner diameter of between approximately 0.1 mm and 1 mm; and discharging an amount of deicing liquid from each opening of each deicing liquid jet at a rate of less than approximately 1.0 l/min.

2. The method according to claim 1, the discharge rate of the deicing liquid being between approximately 0.1 and 1 l/min.

3. The method according to claim 1, the discharge rate of the deicing liquid being between approximately 0.1 and 0.5 l/min.

4. A method for dispensing deicing liquid on lanes of roadways comprising:

discharging a deicing medium from spraying points arranged one of on or near the lanes at a ratio of roadway area in square meters to number of spraying points of between approximately 5:1 and 40:1.

5. The method according to claim 4, wherein the spraying points are composed of spraying heads substantially flushly mounted with the road surface, and the discharging of deicing medium comprises discharging at least one jet of deicing liquid from the spraying heads.

6. The method according to claim 5, wherein the spraying heads are structured and arranged to discharge two jets of deicing liquid.

7. The method according to claim 5, wherein the spraying heads include openings for discharging the jets of deicing liquid, wherein the openings have a smallest inner diameter of between approximately 0.1 mm and 1 mm, and wherein a pressure of the deicing liquid at an inlet of each of said openings is between approximately 5 bar and 20 bar.

8. The method according to claim 7, wherein the smallest inner diameter of the opening being between approximately 0.3 mm and 0.6 mm.

9. The method according to claim 7, wherein the pressure of the deicing liquid at the inlet of the opening being between approximately 10 bar and 15 bar.

10. The method according to claim 4, wherein a duration of the discharging of the jets of deicing liquid is between approximately 9 seconds and 10 minutes.

11. The method according to claim 10, wherein the duration of the discharging is between approximately 30 seconds and 5 minutes.

12. The method according to claim 4, wherein the jets of deicing liquid is ejected a distance between approximately 1 and 4 m.

13. The method according to claim 12, wherein the jets are ejected a distance between approximately 1.5 and 2.5 m.

14. An arrangement for dispensing deicing liquid comprising:

at least one deicing liquid pump;

at least one deicing liquid conduit coupled to said at least one deicing liquid pump;

a plurality of spraying heads coupled to said at least one deicing liquid conduit; and said spraying heads comprising at least one outlet opening having an inner diameter between approximately 0.1 mm and 1 mm;

wherein each of said spraying heads are configured to dispense deicing liquid at a rate between approximately 0.1–1.0 liters/minute, and at a pressure at an inlet of each said spraying heads between approximately 5 and 20 bar.

15. The arrangement according to claim 14, the inner diameter of the outlet opening being between approximately 0.3 mm and 0.6 mm.

16. The arrangement according to claim 14, said at least one outlet opening has a smallest inner diameter between approximately 0.1 mm and 1 mm.

17. The arrangement according to claim 14, said at least one deicing liquid conduit comprising a ring conduit having tap lines coupled to said spraying heads.

18. The arrangement according to claim 14, further comprising valves coupled to said at least one deicing liquid conduit, whereby at least sections of said at least one deicing liquid conduit is filled with liquid when said pump is in a deactivated state.

19. A process for dispensing a deicing liquid onto a traffic area, the process comprising:

arranging a plurality of spraying heads at least one of in and along the traffic area, the spraying heads being arranged so that a ratio of an area of the traffic area in square meters to the number of spraying heads is between approximately 15:1 and 40:1;

discharging the deicing liquid through the spraying heads at a rate between approximately 0.1 and 1.0 l/min.

20. The process according to claim 19, further comprising:

discharging the deicing liquid through the spraying heads for a duration of between approximately 10 seconds and 10 minutes.

21. The process according to claim 20, further comprising:

discharging the deicing liquid through the spraying heads a distance of between approximately 1.0 and 4.0 meters.

22. A roadway deicing system, comprising:

a plurality of spraying points arranged one of on or near the lanes at a ratio of roadway area to number of spraying points of between approximately 15:1 and 40:1;

wherein said spraying points discharge deicing liquid in the form of fine jets.

23. A method for dispensing a deicing liquid onto a traffic area through a stationary spraying arrangement comprising:

arranging deicing liquid jets in the spraying arrangement, including spraying points arranged one of on or near the lanes at a ratio of roadway area to number of spraying points between approximately 15:1 and approximately 40:1;

providing openings for the jets of deicing liquid, the openings having a smallest inner diameter of between approximately 0.1 mm and 1 mm;

creating a pressure, between approximately 5 bar and 20 bar, of the deicing liquid at an inlet of the opening;

discharging an amount of deicing liquid from each deicing liquid jet at a rate of less than approximately 1 l/min, such that the jets of deicing liquid are ejected a distance between approximately 1 and 4 m; and maintaining said discharging between approximately 10 seconds and 10 minutes.

24. The method 23, wherein the spraying points are composed of spraying heads mounted substantially flush with the road surface, and the discharging of deicing medium comprises discharging at least one jet of deicing liquid from the spraying heads.

25. The method according to claim 24, wherein the spraying heads are constructed and arranged to discharge two jets of deicing liquid.

26. The method according to claim 23, wherein the smallest inner diameter of the opening is between approximately 0.3 mm and 0.6 mm.

27. The method according to claim 23, wherein the pressure is between approximately 10 bar and 15 bar.

28. The method according to claim 23, wherein said discharging is maintained between approximately 30 seconds and 5 minutes.

29. The method according to claim 23, wherein the jets are ejected a distance between approximately 1.5 and 2.5 m.

* * * * *